US005212854A

United States Patent [19]

Hollis

[11] Patent Number: 5,212,854

[45] Date of Patent: May 25, 1993

[54] CLIP FOR GARMENT HANGER

[75] Inventor: Joseph C. Hollis, East Bentleigh, Australia

[73] Assignee: Spotless Plastics Pty. Ltd., Victoria, Australia

[21] Appl. No.: 730,258

[22] Filed: Jul. 15, 1991

[51] Int. Cl.[5] ..... A44B 21/00

[52] U.S. Cl. ..... 24/487; 24/530; 24/565

[58] Field of Search ..... 223/85, 91, 93, 96; 24/11 F, 511, 545, 530, 487, 555, 562, 458, 565, 557

[56] References Cited

U.S. PATENT DOCUMENTS

| | | | |
|---|---|---|---|
| 549,145 | 11/1895 | Mickelson | 24/511 X |
| 670,027 | 3/1901 | Malmberg | 24/511 X |
| 948,576 | 2/1910 | Frick | 24/458 X |
| 1,795,256 | 3/1931 | Johnson | 24/511 X |
| 3,665,563 | 5/1972 | Batts . | |
| 3,698,043 | 10/1972 | Batts . | |
| 3,698,607 | 10/1972 | Batts . | |
| 3,745,616 | 7/1973 | Batts . | |
| 3,767,092 | 10/1973 | Garrison et al. . | |
| 3,946,915 | 3/1976 | Crane | 223/96 |
| 4,706,347 | 11/1987 | Lindsay . | |
| 4,765,767 | 8/1988 | Marynissen et al. | 24/11 F X |
| 4,884,726 | 12/1989 | Kolton et al. . | |
| 5,075,935 | 12/1991 | Abdi | 24/511 |

FOREIGN PATENT DOCUMENTS 8101361 5/1981 PCT Int'l Appl. .

*Primary Examiner*—James R. Brittain

*Attorney, Agent, or Firm*—Scully, Scott, Murphy & Presser

[57] ABSTRACT

A clip for a garment hanger H having a fixed jaw (1) and a movable jaw (2) connected by a membrane hinge (3), the movable jaw having an actuator arm (5) extending therefrom, and moulded plastics spring member (13) attached to the fixed jaw by attaching lugs (10,11) engaging openings (8,9) in the fixed jaw (1), said spring member (13) having a spring portion (14) extending angularly from an attaching portion (12) towards the actuating portion (5) of the movable jaw (2) to bias the movable jaw towards the closed position, said hanger H having a hood member (20) which surrounds the actuating portion (5) of the clip to deter inadvertent actuation.

6 Claims, 1 Drawing Sheet

CLIP FOR GARMENT HANGER

FIELD OF THE INVENTION

This invention relates to improvements in clips for garment hangers and other articles which require clips for securing articles together.

BACKGROUND OF THE INVENTION

Most clip hangers for garments presently include a separately formed metal spring to provide the necessary biasing force for maintaining the closing force on the jaws of the clips of the hanger. The use of a separately formed metal spring involves two particular disadvantages:

(1) The arm relatively expensive to manufacture and ship to the hanger manufacturing site, and (2) There is a tendency for the spring to become detached from the hanger in use, involving a serious risk of injury to the user, where the clip is used with relatively thick garments which apply high forces to the clip and spring. A typical clip hanger incorporating a metal spring is described in greater detail in U.S. Pat. No. 3,767,092.

While attempts have been made to form plastics springs for clips, such attempts have enjoyed limited success and their use has not extended to clip hangers for relatively heavy garments. An example of a clip hanger incorporating a plastics spring may be found in Australian Patent No. 526118 in the name B. G. Plastics Pty. Ltd.

SUMMARY OF INVENTION AND OBJECT

It is an object of the present invention to provide an improved spring for a hanger clip which is not only lower in cost but also significantly reduces the likelihood of detachment and consequent injury.

In one aspect, the invention provides a spring for a hanger clip, comprising an anchoring portion and a spring portion, said anchoring portion having projections adapted to positively engage retaining openings in a supporting portion of the hanger or other article, said spring portion extending angularly from said anchoring portion and being substantially planar and configured to act in the nature of a leaf spring.

While the spring according to the invention may be made from any suitable material, including metal, it is preferred that the spring should be moulded from a suitable plastics material, such as a suitable polycarbonate or other plastics material having a suitable memory.

The anchoring portion is preferably formed with a pair of spaced undercut lugs adapted to resiliently engage portions of the hanger or other article when inserted into the retaining openings therein.

In another aspect, the invention provides a clip for a hanger or other article comprising a fixed jaw and a moveable jaw interconnected by an integral hinge, said fixed jaw being adapted for attachment to or forming part of a hanger or other article, an actuating arm extending from said moveable jaw to enable the moveable jaw to be manually separated from the fixed jaw, and spring means for biasing said jaws towards each other to provide a gripping force by means of said jaws, characterised in that said spring means comprises an anchoring portion and a spring portion, said anchoring portion having projection means positioned and configured to engage anchoring openings formed in one of said jaws or in part of said hanger or other article, said spring portion extending from said anchoring portion and being substantially planar and configured to act in the nature of a leaf spring, said spring portion being oriented to engage said actuating arm or a fixed portion of said hanger to provide a closing force to said moveable jaw.

In a preferred form of the invention, said anchoring portion is attached to said fixed jaw and said spring portion extends to engage the actuating arm to provide said closing force. The spring means may be made from any suitable material, including metal, although the spring is preferably made from a suitable plastics material such as polycarbonate or some other plastics material having a suitable memory.

Since the spring means is firmly anchored to the hanger, it is less likely to become detached even if substantial forces are applied to it by having a bulky or heavy garment clipped between the jaws of the clip. Since the clip may be moulded from plastics material, its cost is significantly reduced not only by the lower cost of the plastics material but also by the fact that it may be moulded at the same site as the hanger. The hanger and the integral clip may be moulded from any suitable material such as general purpose polystyrene or high impact polystyrene, or any other suitable plastics material.

Spring loaded clips are widely used in garment hangers and it is desirable to prevent inadvertent opening of such clips during the transportation of garments from the factory to the point of sale. While a number of proposals have been made over the years in an endeavour to prevent inadvertent opening of spring loaded clips, a simple and inexpensive mechanism for preventing such inadvertent opening has not as yet been proposed.

It is another object of the present invention to provide a means for protecting a clip against inadvertent opening in a simple and inexpensive manner.

In a further aspect of the invention, the invention provides a clip for a hanger comprising a pair of gripping jaws in which at last one jaw is moveable with respect to the other, means for biasing the jaws towards the closed position in which an article may be gripped between the gripping jaws, means for opening at least one jaw with respect to the other, and protective means carried by a fixed part of said clip or by part of the hanger on which the clip is provided, said protective means being positioned to substantially prevent other than intentional movement of said opening means.

In one embodiment of the invention in which the clip comprises a fixed jaw and a movable jaw mounted for flexing or pivotal movement with respect to the fixed jaw, said fixed jaw and said moveable jaw each having a gripping portion for actuation of the clip, said gripping portion of said fixed jaw being formed with side portions and an interconnecting top portion which extends towards and past the gripping portions of the moveable jaw to prevent inadvertent contact of said moveable jaw gripping portions. Alternatively, one or more abutments may be formed on the gripping portion of said fixed jaw and aligned with openings in the gripping portion of the moveable jaw to allow the clip to be intentionally actuated but to effectively prevent inadvertent actuation.

BRIEF DESCRIPTION OF DRAWINGS

One preferred form of the invention, which incorporates each of the above aspects of the invention, will now be described with reference to the accompanying drawings in which.

DESCRIPTION OF PREFERRED EMBODIMENT

Figures 1, 2, 3:
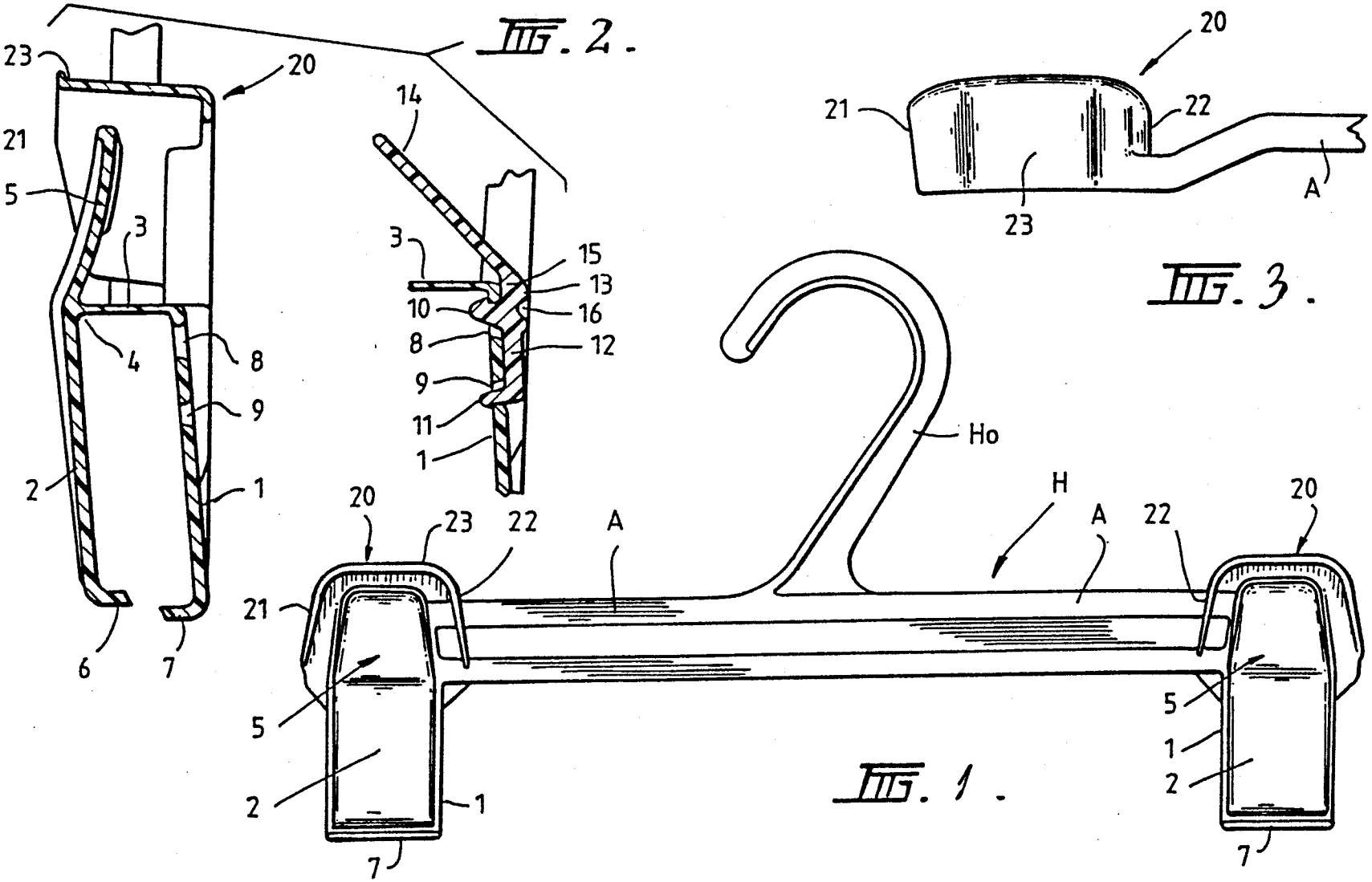
FIG. 1 is a front view of a hanger incorporating clips, spring means and a protective device in accordance with each of the above aspects.
FIG. 2 is a fragmentary sectional and elevation of one of the clips and protective device with the spring device embodying the invention removed for clarity.
FIG. 3 is a fragmentary plan view from above of one clip showing the top of the protective device.

Referring firstly to FIGS. 1 and 2 of the drawings, the clip and spring device embodying the invention comprise a fixed jaw 1 integrally moulded with one of the arms A of a hanger H having a central hook Ho as shown, moveable jaw 2 integrally connected to the fixed jaw by a membrane 3 defining a flexible hinge 4 about which the moveable jaw 2 may be manipulated to open and close the clip, said moveable jaw having an actuator arm 5 extending upwardly from the moveable jaw 2 and by means of which the moveable jaw 2 may be manually manipulated. In the embodiment shown, each jaw 1, 2 has an inwardly directed lower portion 6 and 7 which are slightly vertically offset from each other to allow an article of clothing or the like to be gripped positively by the clip.

The fixed jaw is formed with two vertically spaced attachment openings 8 and 9 for receiving attaching lugs 10 and 11 formed on one face of an attaching portion 12 of a spring member 13 having a spring portion 14 extending angularly therefrom in the direction of the actuating portion 5 of the moveable clip 2. Each abutment 10 and 11 is undercut so as to positively engage the upper and lower portions respectively of the attachment openings 8 and 9 to thereby positively retain the attachment portion 12 firmly in engagement with the fixed jaw 7 so that the spring portion 14 engages the rear face of the actuating arm 5 and positively biases the moveable jaw 2 towards the fixed jaw 1.

The spring means 13 is moulded a suitable plastics material such as polycarbonate, or some other suitable plastics having a suitable memory. The spring means is formed with a neck portion 15 defined by the undercut portion of the abutment 10 and an indentation 16 formed in the opposite face. In use, the spring means 14 flexes about the neck 15 as well as deforming along its length to provide the necessary leaf-spring-like properties. In the prevent embodiment, the spring means 13 is approximately 10 mm wide and the spring portion 14 is essentially planar, the free end portion being rounded to allow smooth engagement between the end of the spring portion 14 and the rear face of the actuating arm 5.

Since the spring means 13 is positively retained in engagement with the fixed jaw 7 and is moulded from plastics material, each of the shortcomings of the prior art referred to above is essentially avoided. The spring means 13 may be easily fitted, either by hand or by means of a suitable machine. With regard to the third aspect of the invention defined above, it will be noted that the actuating arm 5 is protected against inadvertent actuation in use by means of a hood member 20, comprising side wings 21 and 22 and an interconnecting top portion 23. The side portion 22 is integrally moulded with one of the arms A while the side portion is integrally moulded part of the fixed jaw 7.

By enclosing the actuating arm 5 within a protective hood, inadvertent actuation of the clip in the manner described in Australian Provisional Patent Application PJ 8808, filed Feb. 26, 1990 and entitled Wing Protector for Hanger Clip is substantially avoided.

As mentioned above, the spring means 13 may alternatively be made from metal, and although this reduces the cost benefit achieved by moulding the spring means from plastics, it is expect to that the configuration of the spring means described may make the spring less expensive to manufacture than springs of the type described in the prior art.

I claim:

1. A clip for a hanger said clip comprising:
a fixed jaw;
a moveable jaw;
an integral flexible hinge interconnecting said moveable jaw and said fixed jaw;
an actuator arm extending from said moveable jaw to enable said moveable jaw to be manually separated from said fixed jaw; and
a spring means for biasing said moveable jaw toward said fixed jaw to provide a gripping force, wherein said spring means comprises an anchoring portion and a spring portion,
said anchoring portion having projection means positioned and configured to engage anchoring openings formed in said fixed jaw,
said spring portion extending from said anchoring portion and being substantially planar and configured to act in the nature of a leaf spring,
said spring portion being oriented to engage said actuator arm to provide a closing force to said moveable jaw.

2. The clip according to claim 1 wherein said anchoring portion is attached to said fixed jaw and said spring portion extends to engage the actuator arm to provide said closing force.

3. The clip of claim 2 further comprising aligning ribs oriented on the actuator arm to hold the spring portion in position when engaging the actuator arm.

4. The clip according to claim 1 wherein said projection means are spaced undercut lugs adapted to resiliently engage said anchoring openings formed in said fixed jaw.

5. The clip of claim 1 wherein said spring is formed from a suitable plastics material having resilient memory.

6. The clip of claim 1 further comprising protective means that comprises:
a first side that is integrally molded to said fixed jaw;
a second side that is integrally molded to an arm of said hanger; and
a top portion interconnecting said first side and said second side,
said protective means being positioned to substantially prevent other than intentional movement of said actuator arm.

* * * * *

UNITED STATES PATENT AND TRADEMARK OFFICE

CERTIFICATE OF CORRECTION

PATENT NO. : 5,212,854

DATED : May 25, 1993

INVENTOR(S) : Joseph C. Hollis

It is certified that error appears in the above-indentified patent and that said Letters Patent is hereby corrected as shown below:

Column 1, line 16: "arm" should read as --are--

Column 2, line 51: "movable" should read as --moveable--

Column 3, line 49: "prevent" should read as --present--

Column 4, line 13: "expect" should read as --expected--

Signed and Sealed this

Twenty-ninth Day of March, 1994

Bruce Lehman

*Attest:*

BRUCE LEHMAN

*Attesting Officer*

*Commissioner of Patents and Trademarks*